United States Patent [19]

Garcia

[11] Patent Number: 4,828,116

[45] Date of Patent: May 9, 1989

[54] KIT AND PROCESS FOR USE IN MAKING A REPRESENTATION OF A SELECTED PORTION OF A PERSON'S BODY

[76] Inventor: Jose N. Garcia, 9421 SW. 192nd Dr., Miami, Fla. 33157

[21] Appl. No.: 161,564

[22] Filed: Feb. 1, 1988

[51] Int. Cl.[4] ..... B65D 85/00; B28B 7/16

[52] U.S. Cl. ..... 206/575; 264/313; 425/2; 425/256

[58] Field of Search ..... 206/223, 575; 264/313; 425/2, 256, 317, 324.1, 450.1, 470; 434/267, 270

[56] References Cited

U.S. PATENT DOCUMENTS

| | | | |
|---|---|---|---|
| 2,540,432 | 2/1951 | Evans | 425/317 |
| 3,217,067 | 11/1965 | Tencate | 264/313 |
| 3,479,691 | 11/1969 | Durland | 425/2 |
| 3,921,801 | 11/1975 | Sway | 206/575 |
| 4,100,249 | 7/1978 | Giron | 264/313 |
| 4,215,843 | 8/1980 | Gay et al. | 425/317 |
| 4,286,710 | 9/1981 | Higgins | 206/575 |
| 4,294,634 | 10/1981 | Mookil | 434/267 |
| 4,397,701 | 8/1983 | Johnson | 206/575 |
| 4,521,171 | 6/1985 | Noonan, Jr. | 425/2 |
| 4,584,042 | 4/1986 | Wandroik | 206/575 |

FOREIGN PATENT DOCUMENTS

| | | | |
|---|---|---|---|
| 7705210 | 11/1978 | Netherlands | 206/575 |
| 0943586 | 12/1963 | United Kingdom | 425/2 |

*Primary Examiner*—Jimmy G. Foster
*Attorney, Agent, or Firm*—John C. Malloy

[57] ABSTRACT

A kit and a process for making a representative reproduction of a portion of the body of a person in a selected orientation wherein the kit includes a supply of impression material, a mold-defining cavity member, which may be in two parts, and a supply of plaster so that, the impression material, when combined with water, may be first positioned in the cavity of the mold, an impression made, after the selected body portion has been removed from the cavity, a mix of the plaster and water may be placed in the impression made in the material in the cavity allowed to set and then removed as a product representative of the body portion being reproduced.

8 Claims, 1 Drawing Sheet

KIT AND PROCESS FOR USE IN MAKING A REPRESENTATION OF A SELECTED PORTION OF A PERSON'S BODY

FIELD OF THE INVENTION

This invention relates to a kit and a process for reproducing a representative portion of the body of a person, such as the foot, hand or face of a person.

BACKGROUND OF THE INVENTION

Oftentimes people, for various reasons, bronze certain items, such as the first pair of shoes of a child. This invention is of kit for use in reproducing a representative portion of the body of a person in a selected orientation, such as a child's hand in an open position, which can then be painted with a flesh colored dye or paint to be preserved for future enjoyment and reference. Various other portions of the body, such as one's face or foot, may be reproduced utilizing the kit and the process. For example, a young man playing high school or college football may have his hand reproduced utilizing the process and the kit with the product of the process constituting a representation of the hand of the young man in an orientation in which a football or baseball would be held by him. Thereafter, a football or baseball may be placed in the reproduction of the hand of the person and provide a decorative, highly desirable piece for display.

OBJECTS OF THE INVENTION

It is an object of this invention to provide a kit and a process for reproducing a portion of the body of a person, such as a hand, face or foot, wherein the kit includes a supply of impression material and a tray into which the impression material is placed and utilized for making an impression into which there is then placed plaster to set so that, when the impression material is removed, the representation of the portion of the person's body is achieved, which can then be painted with flesh-colored dye or paint.

It is also an object of this invention to provide a process for making a reproduction of a portion of the body of a person in a selected orientation utilizing impression material and a supply of plaster which is intended to set within an impression created in the impression material in a tray so that it can then be utilized as a display product either alone or in combination with other items.

In accordance with these and other objects which will become apparent hereinafter, the instant invention will now be described with reference to the accompanying drawings in which:

DESCRIPTION OF THE PREFERRED EMBODIMENT

Figure 1:
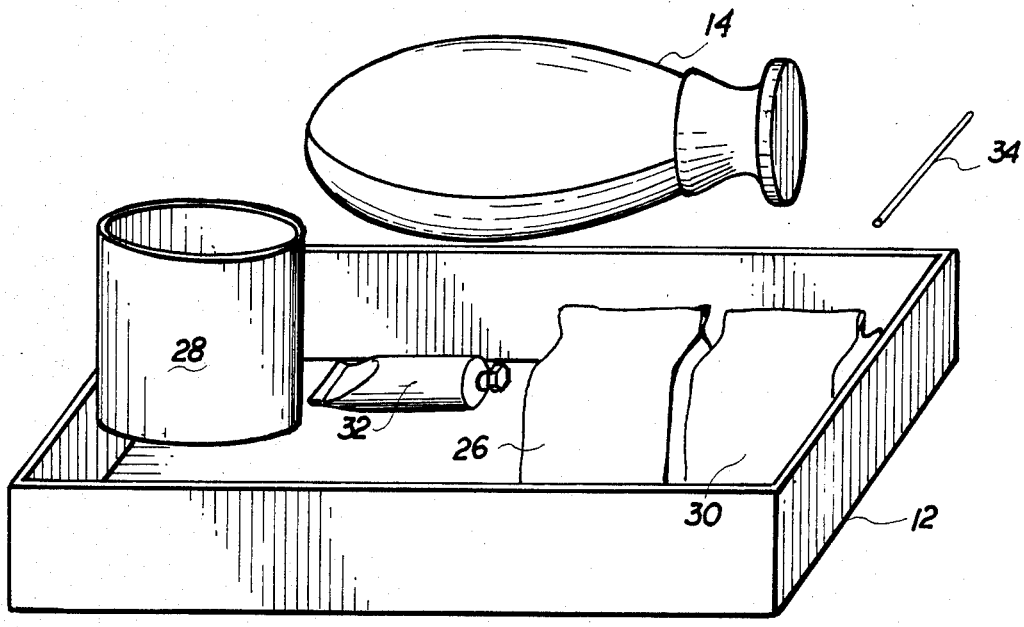
FIG. 1 is a representation of a kit constructed in accordance with this invention and including the items specified more fully hereinafter.
Figure 2:
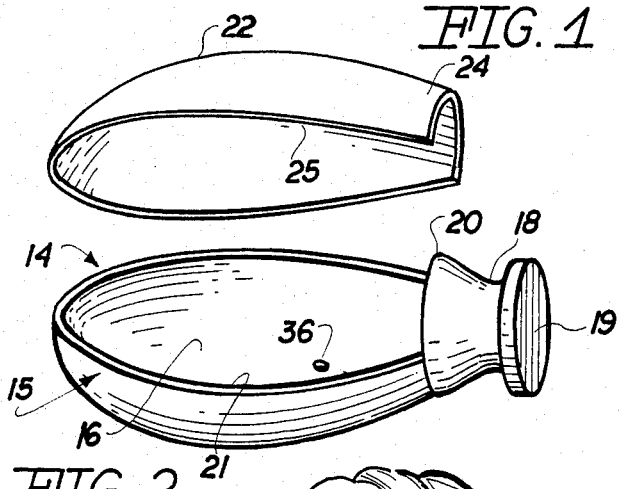
FIG. 2 is a perspective view illustrating the cavity defining mold members of the instant invention.
Figure 3:
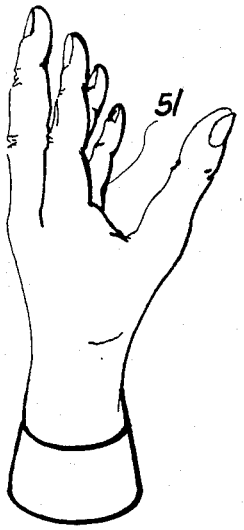
FIG. 3 is a representative product of the kit and the process.
Figure 4:
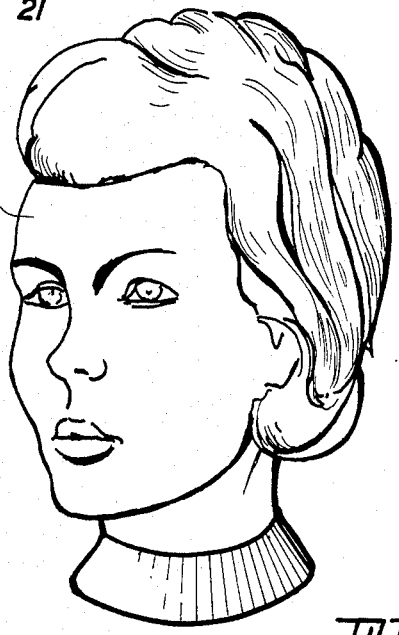
FIG. 4 is a representative product different from FIG. 3 of the kit and process.
Figure 5:
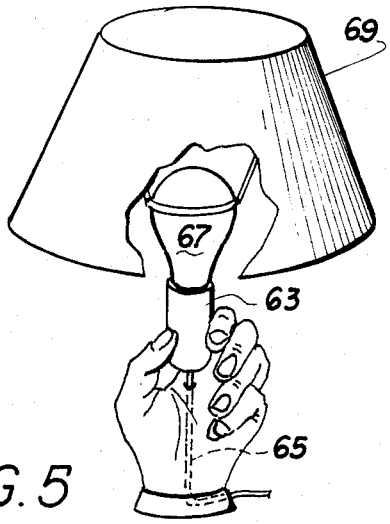
FIG. 5 is a representative sample of a product comprising a lamp made utilizing the kit and the process described more fully hereinafter.

The kit preferably includes a container 12 which may be of cardboard and between 12 and 16 inches in length, about 6 inches wide, and two to three inches in height. In the container various items are provided for carrying out the process set forth more fully hereinafter. First, a tray means 14 is included in the container 12. The tray means may compose one or two cavity defining portions. In any event, the tray portion 15 is dish shaped defining a cavity 16. Preferably, this cavity is about 15 inches in length and 8 inches in width at its open mouth and is about 4½ to 5 inches deep. In a preferred embodiment, the tray 15 may also have an integral stand portion 18 with a flat lower surface 19 with a lip 20 about the lower portion of the cavity if it were to be placed in a vertical position on its end 19. The lip 20 defines a space between its inner surface and the edge 21 of the tray which is sized to mate with a second cavity tray portion 22 one end of which 24 is sized to be received under the lip to close the tray with its edge 25 in close confronting relation to the edge 21 of the first cavity portion.

Also, within the container and as part of the kit, there is a supply of impression material in a sack 26. Preferably, the kit also contains a mixing bowl 28 which is preferably about 8 inches in height and about 5 inches in diameter. Finally, the kit contains about one pound of plaster material in a bag 30, some flesh colored water colors which may be in a tube 32, and a straw 34. In use, the impression material which is preferably wax and in a flowable condition, is put into the tray means 14, for example, in the cavity 16. The one piece tray portion 15 will be utilized either with or without the second tray portion 22. In either event, an impression is made of a portion of the body of a person by pressing that portion of the body in the desired orientation into the impression material. In the case of a face impression, the straw 34 is passed through a hole 36 in the tray and the tray is pressed on the face of a person as he breathes through the straw. In the case of a hand or the foot of a child, for example, the second tray portion is utilized, some of the impression material being in it also, and sandwiched about the foot or hand. The preferred impression material is a product known commercially in the field as "alginate" and a supply in the kit of about 450 grams is preferred because this amount, when mixed with about 150 grams of water, provides enough material for a satisfactory impression of either a face, hand or foot utilizing the trays described. Further, the material sets rapidly and usually in about one minute or so. After the impression has been made, the body portion of the user is removed from the cavity and the plaster 30, preferably about 1 pound which has been mixed with water, is poured into the tray to set. This takes about 45 minutes to an hour. Thereafter, the plaster form representative of the selected body portion is removed from the impression material, using heat as required to melt that impression material. Thereafter, water colors are then utilized to paint the product, which may be representative of a face, hand or foot. The product may then be placed on a stand, much as the bronzed first pair of shoes of a child. Various different items may be made using the product of the above process. For example, if the hand 51 of a person is selected, it may be oriented to hold a football. When set in such a case, a football may be placed in the resultant product. The same may be done in the case of a baseball, etc. Alternatively, a product representing a face 52 may be made. On the other hand, if a light bulb holding orientation has been presented in the tray for the impression, then a lamp 61 may be made by connecting a light bulb socket 33 in the hand, and, a hole 65 drilled through the hand to provide a passageway for electrical conductors to energize the light bulb socket which in turn receives a light bulb 67 in it. Thus, a lamp can be provided and a shade 69 attached to it.

In any event, there has been provided a kit for use in a process to reproduce accurately the hand, foot or face, for example, of a person which is often desired to capture memories and to provide a highly decorative device which is inexpensive and interesting to manufacture.

It is intended that the kit is disposable and will be purchased by persons at outlets where the process will also be performed for educational purposes so that a person interested in duplicating the process may purchase such a kit and utilize it. To this end, the trays may be of styrofoam material and preferably the mixing bowl which is utilized is of inexpensive construction and included with the trays in the kit. However, a purchaser of the tray may utilize a kit which does not include the mixing bowl described above.

While this kit and product had been described in a practical and preferred embodiment, it will be appreciated that departures may be made within the spirit and scope of this invention which should, therefore, not be limited except as set forth in the claims which follow and within the doctrine of equivalents.

What is claimed is:

1. A kit for use in making impressions of a portion of the exterior of the body of a person with the body portion in a selected orientation, which kit comprises:

a container of about 16 inches in length, 8 inches in width and about 6 inches in height, and wherein the container includes therein:

a cavity defining molding tray means into which the mixture of water and impression material is to be placed, and a vessel containing plaster material to be mixed with water to be poured into the impression material after an impression has been made in it of a selected body portion of a person in a desired orientation.

2. The kit as set forth in claim 1 wherein said tray is of disposable material.

3. The kit as set forth in claim 1 wherein said tray means includes an opening therethrough and said kit includes a straw sized for snug receipt in the opening for breathing by a person when an impression is being made of the face of that person.

4. A kit as set forth in claim 1 wherein said kit includes a mixing container for use in mixing the impression material with water.

5. The kit as set forth in claim 1 wherein said impression material is composed of "alginate."

6. The kit as set forth in claim 1 wherein said container includes a supply of flesh colored paint.

7. The kit as set forth in claim 1 wherein said tray means includes a first and a second tray portion for sandwiching the tray portions about a selected body portion of a person in a selected orientation.

8. The kit as set forth in claim 1 wherein the tray portion includes stand portion and means for holding the tray portions together.

* * * * *